US006012173A

United States Patent [19]

Lee

[11] Patent Number: 6,012,173

[45] Date of Patent: Jan. 11, 2000

[54] ATTACHMENT FOR HEADGEAR TO VENTILATE WHILE CLAMPING WEARER'S HEAD

[76] Inventor: Ben Gill-Ho Lee, 2136 Weatherly Pl., Fullerton, Calif. 92633

[21] Appl. No.: 08/870,754

[22] Filed: Jun. 9, 1997

Related U.S. Application Data

[63] Continuation-in-part of application No. 08/821,599, Mar. 20, 1997.

[51] Int. Cl.[7] ..... A42C 5/04

[52] U.S. Cl. ..... 2/195.5; 2/7; 2/182.2; 2/DIG. 1; 223/24; 223/84

[58] Field of Search ..... 2/175.4, 181.2, 2/181.4, 182.1, 182.2, 195.5, DIG. 1, 7; 223/24, 84

[56] References Cited

U.S. PATENT DOCUMENTS

| | | | |
|---|---|---|---|
| 215,998 | 5/1879 | Waddell et al. | 2/181.2 |
| 221,313 | 11/1879 | Hoyt | 2/182.7 |
| 275,670 | 4/1883 | Kendall | 2/182.1 |
| 660,062 | 10/1900 | Mahoney | 2/181.2 |
| 923,986 | 6/1909 | Morigl | 2/181.4 |
| 1,140,812 | 5/1915 | Getler | 2/183 |
| 1,187,507 | 6/1916 | Coyne | 2/182.6 |
| 1,434,743 | 11/1922 | Hardman | 2/182.5 X |
| 1,434,745 | 11/1922 | MacLeod | 2/181.4 |
| 1,530,870 | 3/1925 | Weber | 2/171.7 |
| 1,566,891 | 12/1925 | Lyon | 2/181 X |
| 2,117,764 | 5/1938 | Holmes | 2/183 |
| 2,127,797 | 8/1938 | Wittcoff | 2/182.6 |
| 2,129,798 | 9/1938 | Trumbull | 2/181 |
| 2,383,396 | 8/1945 | Lipton | 132/59 |
| 2,451,140 | 10/1948 | Wittcoff | 2/185 |
| 2,818,574 | 1/1958 | Burnison | 2/181.2 |
| 2,832,077 | 4/1958 | McGinnis | 2/171 |
| 3,089,145 | 5/1963 | Kiefer | 2/177 |
| 3,245,088 | 4/1966 | Robison | 2/181.4 |
| 3,289,212 | 12/1966 | Morgan | 2/3 |
| 3,495,272 | 2/1970 | Tempelhof | 2/3 |
| 3,780,382 | 12/1973 | Boden | 2/182.6 |
| 4,101,981 | 7/1978 | Boden | 2/182.6 |
| 4,131,953 | 1/1979 | Kimotsuki | 2/171.1 |
| 4,274,157 | 6/1981 | Boden | 2/181.4 |
| 4,951,320 | 8/1990 | Yoon | 2/181.2 |
| 5,054,122 | 10/1991 | Sher | 2/7 |
| 5,090,054 | 2/1992 | Grilliot | 2/5 |
| 5,101,516 | 4/1992 | Scarnato | 2/181.2 |
| 5,226,180 | 7/1993 | Leach | 2/411 |
| 5,365,607 | 11/1994 | Benevento | 2/181.4 |

FOREIGN PATENT DOCUMENTS

| | | | |
|---|---|---|---|
| 884067 | 7/1953 | Germany | 2/181.2 |
| 3110593 | 10/1982 | Germany | 2/410 |

*Primary Examiner*—Diana Oleksa

[57] ABSTRACT

An attachment 10 being made with a springy, yet relatively rigid material includes at least one U-shaped arm 12 which is in contact with an internal surface of a crown 22 of a headgear 20. The crown has an opening which is larger than its ordinary size for a wearer's head 30. The arm has two end portions oriented toward the left and right portions of a lower periphery of the crown respectively, spaced apart to each other in a distance shorter than a width between the left and right sides of the head, adapted to clamp the left and right sides of the head in the springy manner, also adapted to make the opening of the crown narrowed in its left and right directions while the opening is lengthened elliptically in its front and rear directions to provide air space to the head, whereby the air space can engage to ventilate scalp 32 of the head keeping cool and dry and also to prevent hair 34 of the head from being disturbed and pressed.

2 Claims, 2 Drawing Sheets

ATTACHMENT FOR HEADGEAR TO VENTILATE WHILE CLAMPING WEARER'S HEAD

This Application is a CIP of Ser. No. 08/821,599 Mar. 20, 1997.

BACKGROUND OF THE INVENTION

The present invention relates to an attachment for a headgear to provide air space to a wearer's head for ventilation, and more particularly to a springy, yet relatively rigid material of the attachment adapted to make an opening of a crown of the headgear narrowed in its left and right directions while the opening of the crown is lengthened elliptically in its front and rear directions to provide air space for ventilation.

For many years, the headgear of various style have been worn both for protection and as fashion apparel, and the wearers of the headgear have been suffered commonly from their inconveniences such as the wearer's hair being disturbed and pressed by the headgear and the wearer's scalp bearing the excessive heat and perspiration.

To date, numerous solution to these problems have been proposed but there remain a continually unsatisfied need for evermore efficient, cost effective, simple and shapely means for the headgear.

For examples, U.S. Pat. Nos. 660,062, 923,986, 1,187,507, 1,434,743, 1,434,745, 1,566,891, 2,129,798, 2,818,574, 2,832,077, 3,289,212, 3,495,272, 4,101,981, 4,274,157, 4,951,320, 5,054,122, 5,101,516, 5,226,180, 5,365,607 and F. R. of Germany Pat. No. 884,067 each of which has the specific type of spacer elements attached to a sweat band of a headgear at the circularly spaced locations each other whereby the space between the spacers engage to ventilate the wearer's head.

For other examples, U.S. Pat. Nos. 221,313, 275,670, 1,140,812, 1,530,870, 2,117,764, 2,127,797, 2,383,396, 2,451,140, 3,780,382, 4,131,953, 5,090,054 and F. R. of Germany Pat. No. 3,110,593 each of which has the specific type of an element or elements attached to and spaced with the inner surface of a crown whereby the space between the crown and the elements engage to ventilate the wearer's head.

U.S. Pat. No. 215,998 issued to Waddell and Sample sets forth a ventilating hat including a circular frame being secured to the underside of a crown of the hat and three angular rests which are adjustably attached to the circular frame and of which the outer parts are curved inwardly and downwardly to provide air space from the hat for ventilation.

U.S. Pat. No. 3,089,145 issued to Kiefer sets forth a sun hat comprising a flat disc and the arcuated spring yoke which is secured at its center to the center of the disc and which terminates with open bifurcated ends adapted to hold the disc on the head at near the ears of the wearer so as to provide complete freedom to the scalp and the maximum of the ventilation.

U.S. Pat. No. 3,245,088 issued to Robison sets forth a sunbathing headgear comprising a conically configured hat and a pair of U-shaped rods of which ends detachably connected respectively to the holes provided in the hat, and which are apart in parallel relation each other to resiliently grip the opposite sides of the wearer's head.

SUMMARY OF THE INVENTION

Present invention is preferably embodied in an attachment made with a springy, yet relatively rigid material, including at least one elongated and U-shaped arm which is in contact with an internal surface of a crown of a headgear. The crown has an opening which is larger than its ordinary size for a wearer's head.

The arm has two ends oriented toward the left and right portions of a lower periphery of the crown respectively, spaced apart to each other in a distance shorter than a width of the left and right sides of the head, adapted to clamp the left and right sides of the head in the springy manner, and also adapted to make an opening of the crown narrowed in its left and right directions while the opening is lengthened elliptically in its front and rear directions so as to provide air space to the head.

Accordingly it is an object of the present invention to provide space between the crown and the wearer's head particularly along the front and rear sides of the head whereby scalp of the wearer's head can be ventilated keeping dry and cool, the hair of the head can be stayed preventing from being disturbed and pressed, and the perspiration of the head can flow down preventing the headgear from being water stained and damaged.

Another object of the present invention is that the attachment can be detachably attached to the headgear by the simple movements of unfolding and refolding an inner band of the headgear so as to eliminate needs for any fastening means member.

Still another object of the present invention is that the attachment can be adapted to clamp the wearer's head at only the left and right sides thereof in order to hold the headgear in place on the head.

Still another object of the present invention is that the larger sized headgear can be utilized and therefore the fewer sizes of the headgear can be manufactured.

Still another object of the present invention is to make the headgear better shaped by narrowing the opening of the crown at its left and right sides and also by stretching the crown outwardly.

Still another object of the present invention is that the attachment is of simple construction, is readily and economically manufactured and yet is effective in accomplishing its intended purpose.

Other objects and further scope of the applicability of the present invention will become apparent from the detailed description given hereinafter. It should be understood, however, that the detailed description and specific examples, while indicating preferred embodiments of the invention, are given by way of illustration only since various changes and modifications within the spirit and scope of the invention will become apparent to those skilled in the art from the detailed description.

BRIEF DESCRIPTION OF THE DRAWING

The above and other features and objects of the present invention will be better understood from the following detailed description of the typical embodiments illustrated in the accompanying drawings, in which.

DESCRIPTION OF THE PREFERRED EMBODIMENTS

Figure 1:
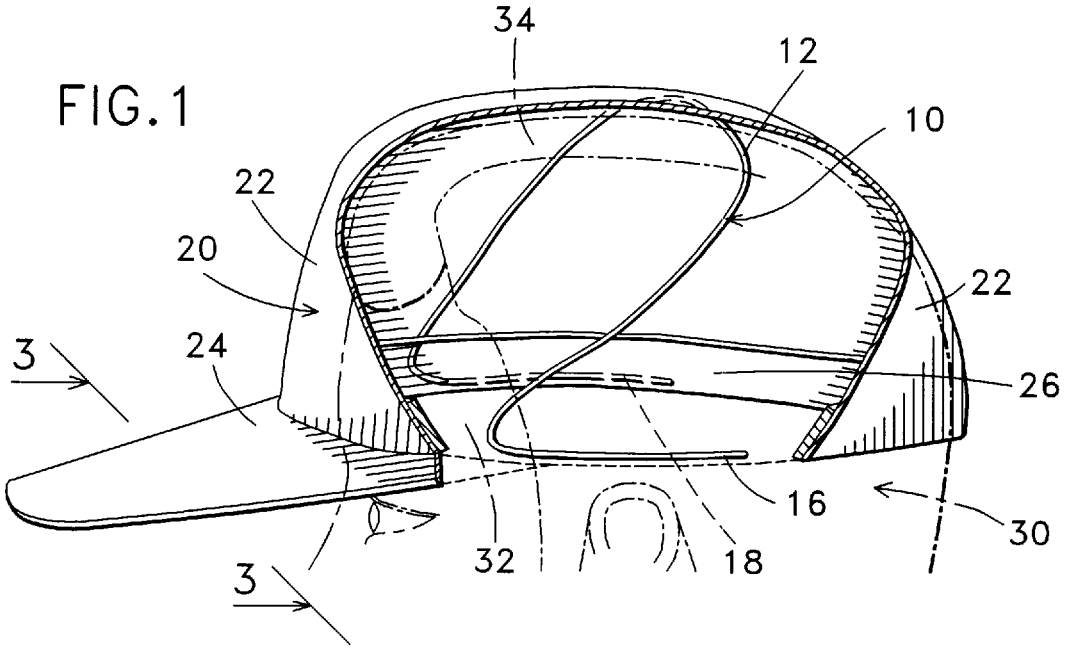
FIG. 1 illustrates a partially broken away perspective view of a headgear 20 in order to show an embodiment of an attachment 10 installed to the headgear and also to show a wearer's head 30 wearing the headgear in a typical fashion.
Figure 2:
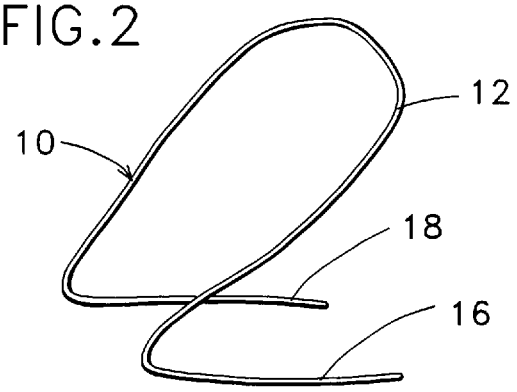
FIG. 2 illustrates a perspective view of the attachment 10.
Figure 3:
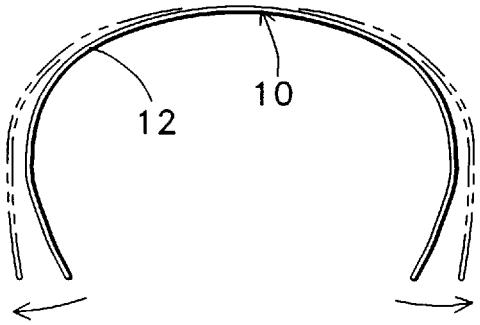
FIG. 3 illustrates an elevation view of the attachment 10 taken along lines 3—3 of FIG. 1.

Now with more detailed reference to the drawings FIG. 1–3, the present invention, an attachment 10 for a headgear 20 to ventilate while clamping a wearer's head 30, comprises an elongated and U-shaped arm 12 and two elongated bases 16, 18 spaced laterally apart to each other.

The arm 12 is oriented in a transverse direction to the bases 16, 18 of which each has two ends, and the arm has two ends fixedly connected to the corresponding ends of the bases respectively.

The attachment 10 is formed or molded in one piece with a springy, yet relatively rigid material such as metal, plastic or the other synthetic.

The headgear 20 has a dome-shaped crown 22 which has an internal surface of which a lower periphery defining an opening to the interior cavity of the crown, a brim or visor 24 integral therewith, and an inner band 26 which has a lower edge which is stitched together with the lower periphery of the internal surface of the crown so as to have a stitched line thereof.

The internal surface of the crown 22 has its left and right portions adapted to encompass the left and right sides of the wearer's head 30.

To install the attachment 10 into the headgear 20, first, the attachment are inserted into the opening of the crown 22, and, as the arm 12 is in contact with the internal surface of the crown, the bases 16, 18 are aligned with the left and right portions of the lower edge of the band 26 respectively.

Then, as the band 26 is unfolded downwardly, the bases 16, 18 are placed between the crown 22 and the band at immediately above their stitched line, and then the unfolded band is refolded back to its original position, so that the attachment can be detachably secured to the headgear with no needs for any other fastening means member.

The arm 12 is adequately shaped and sized to fit into the internal surface of the crown 22, so that the arm can be adapted to stretch the crown outwardly.

The ends of the arm 12 are spaced apart to each other in a distance shorter than a width between the left and right sides of the wearer's head 30.

As the headgear 20 is putted on the wearer's head 30, the end portions of the arm 12 are spread to each other in the left and right directions in the springy manner so as to clamp the left and right sides of the wearer's head in order to hold the headgear in place on the head.

The opening of the crown 22 of the headgear 20 is larger than its ordinary size for the wearer's head 30 so that fewer sizes of the headgear can fit to most people because a certain larger size of the headgear can fit with the wider range of sizes of the wearer's heads.

In accordance with an important aspect of the present invention, the arm which has a springy, yet relatively rigid characteristic is adapted to make the opening of the crown 22 narrowed in its left and right directions while the opening is lengthened in its front and rear directions, making the opening into an ellipse shape, so as to provide air space from the headgear 20 to the wearer's head 30 particularly along the front and rear sides of the head, whereby scalp 32 of the head can be ventilated through the air space to keep dry and cool, hair 34 of the head can be stayed within the air space to prevent from being disturbed and pressed, and the perspiration on the head can flow down through the air space to prevent the headgear 20 from being water stained and damaged. Advantageously the attachment 10 is of simple construction, is readily and economically manufactured and yet is effective in accomplishing its intended purpose as described above.

Figure 4:
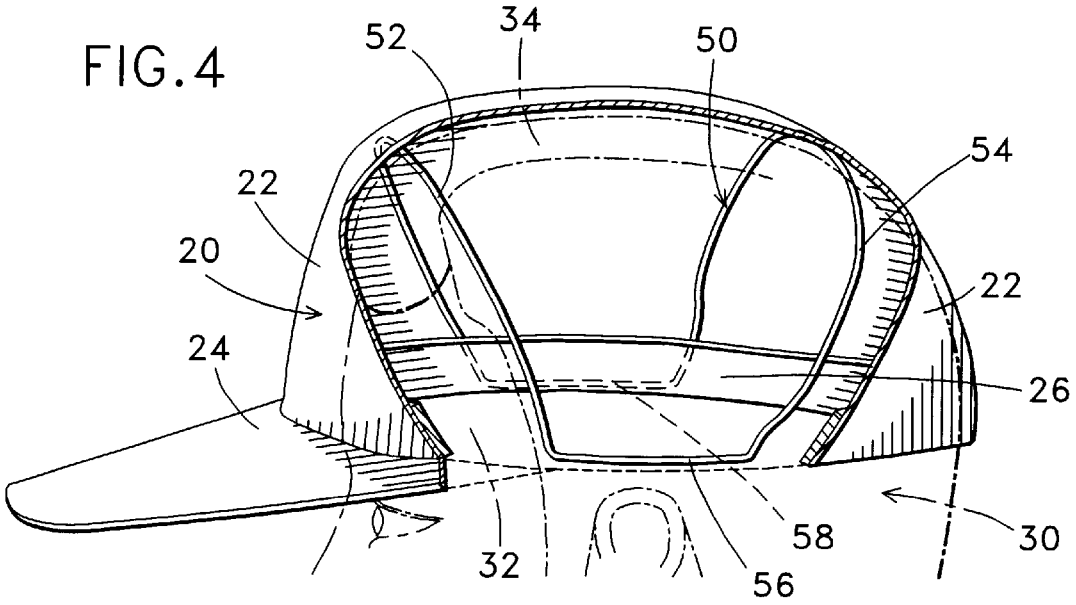
FIG. 4 illustrates a partially broken away perspective view of the headgear 20 in order to show an alternative attachment 50 installed to the headgear and also show the wearer's head 30 wearing the headgear in a typical fashion.
Figure 5:
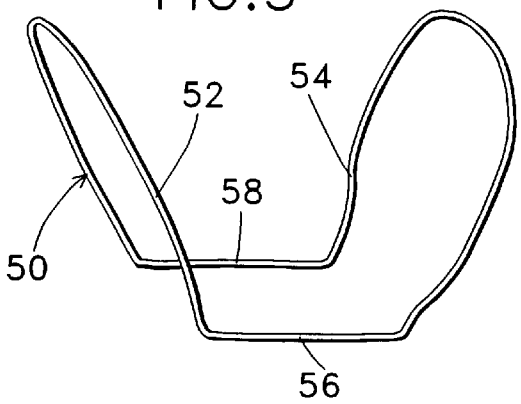
FIG. 5 illustrates a perspective view of the alternative attachment 50.

An alternative attachment 50 for the headgear 20, as illustrated in FIGS. 4–5, comprises two elongated and U-shaped arms 52, 54 spaced laterally apart to each other and two elongated bases 56, 58 spaced laterally apart to each other.

The bases 56, 58 are aligned with the left and right portions of the lower periphery of the crown 22 respectively, are located between the band 26 and the crown at immediately above their stitched line, and each base has two ends.

The arms 52, 54 are in contact with the internal surface of the crown 22 at the front and rear portions of the crown respectively.

Each arm 52, 54 has two ends oriented toward the left and right portions of the lower periphery of the crown 22 respectively, and the ends of each arm are connected fixedly to the corresponding ends of the bases 56, 58 respectively.

The ends of each arm 52, 54 are spaced apart to each other in a distance shorter than a width between the left and right sides of the wearer's head 30.

Each of the attachments 10, 50, described here, utilizing the headgear 20 of which the crown 22 has the opening which is larger than its ordinary size for the wearer's head 30, has at least one arm member 12, 52, 54 having the springy, yet relatively rigid characteristic adapted to make the opening of the crown narrowed in its left and right directions while the opening is lengthened in its front and rear directions, making the opening into an ellipse shape, so as to provide air space from the headgear to the wearer's head, particularly along the front and rear sides of the wearer's head, for air circulation to the wearer's head.

As is apparent from the foregoing specification, the invention is susceptible of being embodied with various alterations and modifications which may differ particularly from those that have described in the preceding specification and description recognizing various modification been apparent the scope herein shall be deemed as defined in the claims set forth hereinafter.

What is claimed:

1. An attachment in combination with a headgear comprising:

said headgear comprising:

a dome-shaped crown which is adapted to cover a wearer's head, said crown having an internal surface having a lower periphery defining an opening to the interior cavity of said crown, said opening adapted to be larger than an ordinary size for said wearer's head, said internal surface having its left and right portions adapted to encompass the left and right sides of said wearer's head respectively, an inner band having a lower edge stitched together with said lower periphery of said internal surface of said crown so as to have a stitched line thereof;

said attachment comprising:

at least one elongated and U-shaped arm made with a springy, yet relatively rigid material, said arm being in contact with said internal surface of said crown, having two ends oriented toward the left and right portions of said lower periphery of said crown respectively, said arm of which ends are spaced apart to each other in a distance shorter than a width between the left and right sides of said wearer's head, two elongated bases aligned with the left and right portions of said lower periphery of said crown respectively, located between said band and said crown at immediately above said stitched line thereof, each said base having two ends, said ends of said arm being fixedly connected to corresponding ends of said bases respectively;

whereby, when said band is unfolded downwardly, said bases are placed between said band and said crown immediately above said stitched line thereof, and then, said unfolded band is refolded to its original position, said attachment can be detachably secured to said headgear, and whereby said attachment is adapted to clamp the left and right sides of said wearer's head in a springy manner in order to hold said headgear in place on said head, and said attachment is also adapted to make said opening of said crown narrowed in its left and right directions while said opening is lengthened in its front and rear directions, making said opening into an ellipse shape, so as to provide air space from said headgear to the front and rear sides of said head, so that scalp of said head can be ventilated through said air space to keep dry and cool, hair of said head can stay within said air space to prevent from being disturbed and pressed, and perspiration on said head can flow down through said air space to prevent said headgear from being water stained and damaged.

2. An attachment in combination with a headgear of claim 1 wherein said arm comprises two arms spaced laterally apart to each other, said arms positioned to the front and rear portions of said internal surface of said crown respectively, each said arm having two ends which are fixedly connected to corresponding ends of said bases respectively.

* * * * *